US005534377A

United States Patent [19]

Takano et al.

[11] Patent Number: 5,534,377

[45] Date of Patent: Jul. 9, 1996

[54] NONMAGNETIC ONE-COMPONENT DEVELOPING METHOD

[75] Inventors: Masao Takano, Wheeling; Ryozo Okuno, Buffalo Grove; Kimihiko Nakamura, Wheeling, all of Ill.

[73] Assignee: Tomoegawa Paper Co., Ltd., Tokyo, Japan

[21] Appl. No.: 351,053

[22] Filed: Nov. 28, 1994

Related U.S. Application Data

[63] Continuation of Ser. No. 996,405, Dec. 23, 1992, abandoned, which is a continuation-in-part of Ser. No. 661,621, Feb. 28, 1991, abandoned.

[51] Int. Cl.[6] ..... G03G 13/08

[52] U.S. Cl. ..... 430/102; 430/120

[58] Field of Search ..... 430/106, 106.6, 430/110, 111, 903, 102, 120

[56] References Cited

U.S. PATENT DOCUMENTS

| | | | |
|---|---|---|---|
| 4,623,605 | 11/1986 | Kato et al. | 430/110 |
| 4,640,882 | 2/1987 | Mitsuhashi et al. | 430/110 |
| 4,741,984 | 5/1988 | Imai et al. | 430/106.6 |
| 4,868,084 | 9/1989 | Uchide et al. | 430/110 |
| 4,902,570 | 2/1990 | Heinemann et al. | 428/405 |
| 5,021,317 | 6/1991 | Matsubara et al. | 430/110 |
| 5,024,915 | 6/1991 | Sato et al. | 430/110 |
| 5,041,351 | 8/1991 | Kitamori et al. | 430/106.6 |
| 5,043,239 | 8/1991 | Kukimoto | 430/100 |
| 5,215,849 | 6/1993 | Makuta et al. | 430/110 |

*Primary Examiner*—John Goodrow
*Attorney, Agent, or Firm*—Wenderoth, Lind & Ponack

[57] ABSTRACT

A contact-type nonmagnetic one-component developing method using a developing apparatus having at least a developer carrying member and a developer layer thickness control member provided so as to be adjacent to, or to be in contact under pressure with, said developer carrying member, which method comprises feeding a developer to said developer carrying member, forming a thin layer of the developer on a surface of the developer carrying member with the developer layer thickness control member with negatively charging the developer under friction, bringing the thin layer of the developer into contact with a photoconductive material holding an electrostatic latent image to develop the electrostatic latent image, and transferring the resultant developed image to an image receptor, said developer being a nonmagnetic one-component developer prepared by attaching fine particles of an additive to be positively charged to particles of a toner which is comprised mainly of a binder resin and a colorant and which is to be negatively charged, said developer being designed to be negatively charged under the friction in a hopper, the amount of fine particles of the additive being 0.05 to 3 parts by weight per 100 parts by weight of the toner.

11 Claims, 1 Drawing Sheet

NONMAGNETIC ONE-COMPONENT DEVELOPING METHOD

This application is a continuation of now abandoned application Ser. No. 07/996,405, filed Dec. 23, 1992, is a continuation-in-part application of now abandoned application, Ser. No. 07/661,621 filed Feb. 28, 1993.

FIELD OF THE INVENTION

This invention relates to a nonmagnetic one-component developing method which comprises forming a thin layer of a nonmagnetic developer on a developer carrying member and developing an electrostatic latent image on a photoconductive material.

PRIOR ART OF THE INVENTION

Conventional developing methods for developing an electrostatic latent image, which utilize an electrostatic latent image and a nonmagnetic toner (to be simply referred to as "toner" hereinafter), are generally classified into a method using a two-component developer comprising a toner and carrier and a method using a one-component developer containing a toner alone.

The method using a two-component developer can give relatively stable images. Since, however, this method is liable to cause the deterioration of the carrier and a change in the mixing ratio of the toner and the carrier, it is difficult to reproduce images having a constant quality for a long period of time. Further, there are also drawbacks in that the maintenance of a copying machine is complicated and it is difficult to decrease the size of the copying machine. For these reasons, the developing method using a one-component developer containing a toner alone, which is free from the above drawbacks, has now attracted attention.

In the one-component developing method, it is general practice to use a method which comprises carrying a toner with a toner carrying member and developing an electrostatic latent image formed on a photoconductive material with the carried toner. It is desirable that the layer of toner carried on the surface of the toner carrying member has as small a thickness as possible. When this toner layer thickness increases, only the surface of the toner layer is charged, and it is difficult to uniformly charge the toner layer as a whole. Therefore, a variety of toner layer thickness control members have been proposed. For example, it is proposed to use a doctor blade which faces the toner carrying member in order to control the toner layer thickness.

When a developing apparatus having the above toner carrying member and the above toner layer thickness control member is used, clear images can be obtained at an initial stage since a good thin layer of a toner is formed on the toner carrying member. However, when such a developing apparatus is used for a long period of time, formed images are likely to show surface scumming or white streaks. The reasons therefor are assumed to be as follows: When the developing apparatus is operated for a long period of time, heat is generated due to the friction between the toner and the toner layer thickness control member to fuse the toner, and the fused toner adheres partially to the toner layer thickness control member and the toner carrying member. As a result, no uniform thin layer of the toner can be formed. Further, since tribo-electrification is eventually nonuniform, the tribo-electrication value of the toner decreases.

SUMMARY OF THE INVENTION

It is an object of this invention to provide a nonmagnetic one-component developing method which makes it possible to form a good thin layer of a developer on a developer carrying member even when a development operation is carried out for a long period of time.

It is another object of this invention to provide a nonmagnetic one-component developing method which is free from fusion of a developer onto a developer layer thickness control member and a developer carrying member even when a development operation is carried out for a long period of time.

According to this invention, there is provided a contact-type nonmagnetic one-component developing method using a developing apparatus having at least a developer carrying member and a developer layer thickness control member provided so as to be adjacent to, or to be in contact under pressure with, said developer carrying member. The method comprises feeding a developer to said developer carrying member, forming a thin layer of the developer on a surface of the developer carrying member with the developer layer thickness control member with negatively charging the developer under friction, bringing the thin layer of the developer into contact with a photoconductive material holding an electrostatic latent image to develop the electrostatic latent image, and transferring the resultant developed image to an image receptor. In the method the developer is a nonmagnetic one-component developer prepared by attaching fine particles of an additive to be positively charged to particles of a toner which is comprised mainly of a binder resin and a colorant which is to be negatively charged. The developer is to be negatively charged under the friction, and the amount of fine particles of the additive is 0.05 to 3 parts by weight per 100 parts by weight of the toner.

DETAILED DESCRIPTION OF THE INVENTION

Figure 1:
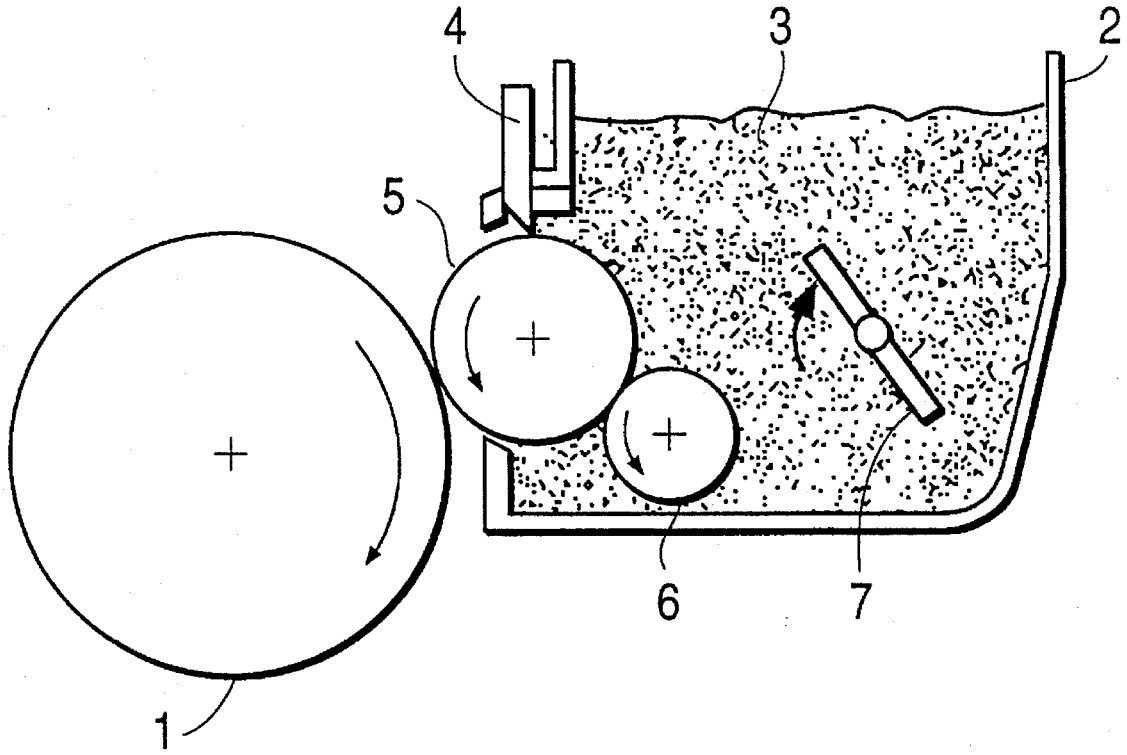
FIG. 1 is a schematic cross-sectional view of a developing apparatus for use in the nonmagnetic one-component developing method of this invention.

The present inventors have found that a developer which is prepared by attaching an additive to show positive tribocharge to a negatively chargeable toner and which is negatively chargeable under friction is applied to a nonmagnetic one-component method, the above developer is free from fusion onto a developer layer thickness control member and a developer carrying member, and high-quality images can be reproduced even when a development operation is continued for a long period of time: The present invention has been completed on the basis of this finding.

U.S. Pat. Nos. 4,623,605, 5,024,915, 4640,882 and 4,902,570 disclose developers composed mainly of toner particles and additives. More specifically, U.S. Pat. No. 4,623,605 discloses a developer which is composed of a positively chargeable carrier and a negatively chargeable toner and which is usable in a two-component developing method. In this developer, the negatively chargeable toner is treated with fine particles which show negative tribocharge when measured by a blow-off method. The developer of U.S. Pat. No. 4,623,605 differs from the developer used in the present invention in the polarity of the employed fine particles and developing method. U.S. Pat. No. 4,623,605 uses fine particles having negative tribocharge and a magnetic brush developing method. U.S. Pat. No. 5,024,915 discloses a developer composed of a toner and positively chargeable fine particles treated with a silane coupling agent. This developer is positively chargeable and is different from the developer used in the present invention in polarity and developing method. That is, this developer is not a nonmagnetic developer, nor is it used in a nonmagnetic developing method. U.S. Pat. No. 4,640,882 discloses a method in which a negatively charged latent image on a photoconductive material is developed with a positively chargeable developer, and the developer is composed of positively chargeable fine particles and a positively chargeable toner. This developer differs from the developer used in the present invention in polarity. Further, U.S. Pat. No. 4,640,882 has not at all taken a nonmagnetic one-component developing method into consideration. U.S. Pat. No. 4,902,570 discloses one-component toner and a two-component toner which are all positively charged with metal oxide treated with ammonium-modified organopolysiloxane. These toners before treament and when treated with the metal oxide are positively charged, and differ from the developer used in the present invention in polarity. Further, U.S. Pat. No. 4,902,570 suggests no idea of a nonmagnetic developing method. As described above, the present invention has been completed by finding that an excellent function and effect can be achieved when the developer having a different constitution from any one of the above prior art developers is applied to a nonmagnetic one-component developing method.

This invention is explained hereinafter by reference to drawings.

FIG. 1 is a schematic cross-sectional view of a developing apparatus for use according to the contact-type nonmagnetic one-component developing method of this invention, in which numeral 1 indicates a cylindrical photoconductive drum to hold an electrostatic latent image, numeral 2 indicates a hopper, numeral 3 indicates a developer, numeral 4 is a doctor blade as a developer layer thickness control member, numeral 5 is a developing roll carrying the developer on its surface as a developer carrying member, numeral 6 indicates a toner feed roll, and numeral 7 indicates an agitator. The developer layer thickness control member may be a doctor blade or a roll which is to rotate reversely to the rotation of the developing roll, and in general, it is formed of a synthetic rubber such a silicone rubber, etc., or a plate of a metal such as brass, etc. The developer feed roll 6 has a function of facilitating the support of the developer on the developing roll surface by frictionally electrifying the developer in the nip portion between itself and the developing roll. An electrostatic latent image is formed on the photoconductive drum 1 by known electrophotography. The hopper 2 stores the developer 3. The developer 3 is held on the surface of the developing roll 5 in such a manner that it has a constant layer thickness under the control of the developer layer thickness control member 4, and the developer is carried to the photoconductive drum. The developer is tribo-charged when the developer is so adjusted as to have a constant thickness on the developing roll under the control of the doctor blade as a developer layer thickness control member. The developer may be charged by connecting the developer layer thickness control member to a direct current or alternate current power source thereby to generate an electric field between the developer carrying member and the developer layer thickness control member. The developer 3 held on the developing roll 5 is conveyed by the rotation of said roll, and brought into contact with the photoconductive drum 1 holding an electrostatic latent image, whereby the latent image is developed.

The roll as a developer carrying member contains a developing roll and a toner feed roll, and has elasticity. Said roll may be formed of an electrically conductive material, or it may have a surface layer formed of an electrically conductive material, such that a bias voltage can be applied. Said roll is preferably formed of a rubber such as a silicone rubber, etc., or an elastic material such as a sponge rubber, urethane foam, etc. These elastic materials may contain an electrically conductive powder such as carbon black, etc. The surface of said roll may be coated with an electrically conductive coating composition. The roll as a developer carrying member in this invention may be provided with a developer holding layer. The developer holding layer is formed of a thin resin layer having suitable elasticity. The material for forming the thin resin layer is selected preferably from film-forming resins such as a fluorine-containing resin, a silicone resin, a polyester resin, a polycarbonate resin, etc. The developer holding layer preferably has a thickness of 10 to 200 μm.

The nonmagnetic one-component developer for use in this invention is a developer prepared by attaching fine particles of an additive to be positively charged to a surface of a toner which is comprised mainly of a binder resin and a colorant and is to be negatively charged. The binder resin and colorant are not specially limited as long as the toner is negatively charged. For example, the binder resin can be selected from polystyrene, polyester, an ethylene-vinyl chloride copolymer, an ethylene-vinyl acetate copolymer, polyamide, polyethylene, a maleate resin, an acrylic resin, an epoxy resin, a coumarone-indene resin, a ketone resin, a petroleum resin, a phenolic resin, etc. The colorant can be selected from carbon black, acetylene black, amp black, channel black, Fanal Blue, Permanent Blue, Nigrosine Blue, Phthalocyanine Blue, Rose Bengal, C.I. Pigment Red C.I. Pigment Yellow 12, etc. In general, the amount of the colorant is preferably 1 to 10 parts by weight per 100 parts by weight of the binder. Further, the above binder may contain other conventional additives such as a charge controlling agent, etc. The toner preferably has an average particle diameter of about 30 μm or less.

Toner particles and developers to which the toner particles are attached are measured for their friction-induced charges as follows. While a toner or a developer is trapped in a Faraday gage of an intake method using a filter layer on the outlet side, it is measured for its friction-induced charge. The toner particles and developers used in the present invention show negative polarity when measured as above. More specifically, the toner particles used in the present invention preferably show a charge of −10 to 30 μc/g, and the developer used in the present invention show a charge of −5 to 30 μc/g.

The amount of attached fine particles of the additive to be positively charged is 0.05 to 3 parts by weight, preferably 0.1 to 1 parts by weight per 100 parts by weight of the toner. When the amount of the attached fine particles of the additive is less than the above lower limit, the fusion of the developer onto the developer layer thickness control member or the developer carrying member cannot be prevented. When said amount is more than the above upper limit, it is difficult to uniformly attach the fine particles to the toner surface. It is not clear why the fine particles of the additive can have an effect on the prevention of the fusion of the developer onto the developer layer thickness control member, etc. As far as the present inventors have made a study, differences in the form of the additive and electric resistance showed no different effect on the prevention of the fusion of the toner onto the toner carrying member. Therefore, the present inventors have assumed that the electric attaching power differs depending upon polarity of fine particles of the additive, and arrived at this invention. The fine particles of the additive can be attached to the toner by a variety of conventional methods. For example, the specified proportions of the above two components may be blended, and then stirred with a Henschel mixer, a turbine stirrer, or the like.

The fine particles of the additive to be positively charged are fine particles of an additive showing a positive tribo-charge, i.e. positive polarity of tribo-electrification when 2 g of the additive which has been allowed to stand overnight under an environment having a temperature of 25° C. and a relative humidity of 50 to 60% is mixed with 98 g of a carrier of an iron powder which has a main grain size of 200 to 300 mesh and is uncoated with resin (e.g. trade name: TEFV 200/300, supplied by Nihon Teppun K.K.), and the resultant mixture is measured for a tribo-electrification value by a blow-off method.

Examples of the fine particles of the additive to be positively charged are as specified in the following A and B.

A. Inorganic fine powders which are surface-treated with aminosilane, silicone oil having an amine in the side chain, a silane coupling agent, a titanium coupling agent, or the like. The inorganic fine powders can be selected from colloidal silica, alumina, titanium dioxide, barium titanate, zinc oxide, silica sand, clay, mica, wollastonite, diatomaceous earth, inorganic oxide pigments, chromium oxide, cerium oxide, iron oxide red, iron oxide, iron sand, γ-ferrite, rare earth ferrite, antimony trioxide, magnesium oxide, zirconium oxide, etc. These fine powders preferably have an average particle diameter of about 500 nm or less.

The above aminosilane for surface treatment has the following formula, $$X_mSiY_n$$

wherein X is alkoxy or halogen, m is an integer of 1 to 3, Y is a hydrocarbon having 1 to 3 amino groups, and n is an integer of 1 to 3.

Examples of the above aminosilane include the following compounds.

$$H_2N-CH_2CH_2NHCH_2CH_2CH_2-\overset{\overset{CH_3}{|}}{Si}-(OCH_3)_2$$

$H_2CONH—CH_2CH_2CH_2—Si—(OC_2H_5)_3$ $H_2N—CH_2CH_2CH_2NHCH_2CH_2CH_2—Si—(OCH_2)_3$ $H_2N—CH_2CH_2NHCH_2CH_2CH_2—Si—(OCH_2)_3$ $H_2N—CH_2CH_2CH_2—Si—(OCH_3)_3$ $_2CH_2—Si—(OCH_3)_3$ $H_2N—CH_2CH_2NHCH_2CH_2NHCH_2CH_2—Si—(OCH_3)_3$ $H_5C_2OCOCH_2CH_2NHCH_2CH_2CH_2—Si—(OCH_3)_3$ $H_5C_2OCOCH_2CH_2NHCH_2CH_2NHCH_2CH_2CH_2—Si—(OCH_3)_3$ $H_5C_2OCOCH_2CH_2NHCH_2CH_2NHCH_2CH_2$ $NHCH_2CH_2CH_2—Si—(OCH_3)_3$ $NH_2C_6H_4—Si—(OCH_3)_3$ $C_6H_5NHCH_2CH_2CH_2—Si—(OCH_3)_3$

Polyaminoalkyltrialkoxysilane

The above compounds may be used alone or in combination.

The silicone oil having an amine in the side chain has the following formula,

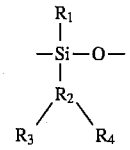

wherein $R_1$ is hydrogen, alkyl, aryl or alkoxy, $R_2$ is alkylene or phenylene, and each of $R_3$ and $R_4$ is independently hydrogen, alkyl or aryl, provided that these alkyl, aryl, alkylene and phenylene may contain an amine and may have a substituent such as halogen, etc., as far as the substituent does not impair the electrification properties of the developer. The silicone oil having an amine in the side chain is available on the market, and preferred is a modified silicone oil having the following formula,

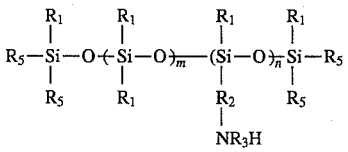

wherein each of $R_1$ and $R_5$ is independently alkyl or aryl, $R_2$is alkylene, phenylene or alkyl having an amine, $R_3$ is hydrogen, alkyl or aryl, and each of m and n is independently an integer of not less than 1.

In view of ease in positive polarity control, preferred are those silicone oils which have an amine equivalent of 320 to 8,800 and a viscosity, measured at 25° C., of 20 to 5,000 cps, preferably of 20 to 3,500 cps.

The silane coupling agent is an organosilicon monomer having at least two reactive groups, which are different from each other, in the molecule. One of the reactive groups chemically bonds to an inorganic substance, and examples o f such a group include methoxy, ethoxy, cellosolve, etc. The other of the reactive groups chemically bonds to an organic material, and examples thereof include amino. An amino-containing silane coupling agent is particularly preferred in this invention, and can be selected from N-β(aminoethyl)-γ-aminopropyltrimethoxysilane, N-β(aminoethyl)γ-aminopropylmethyldimethoxysilane, γ-aminopropyl-triethoxysilane, N-phenyl-γ-aminopropyltrimethoxysilane, etc.

Examples (trade names) of the commercially available inorganic fine powders treated with any of the above surface treating agents are Aerosil CS-2 (supplied by Nihon Aerosil K.K.), HVK2115 and HVK2150 (supplied by Hoechst), MZ-5 and MZ-10 (supplied by Toray Silicone K.K.), KF393, KF857, X-22-38108, X-22-380D (supplied by Shin-etsu Chemical Co., Ltd.), and the like.

The inorganic fine powder is surface-treated with the above surface treating agent according to a variety of known methods. For example, while the inorganic fine powder is stirred, a solution of the surface treating agent is sprayed to the inorganic fine powder, or evaporated and blown Alternatively, while a slurry of the inorganic fine powder is stirred, a solution of the surface treating agent is added dropwise. In addition, the surface-treated inorganic fine powder may be subjected to heat treatment, and the temperature therefor is preferably 50 to 400° C. The amount of the surface treating agent on the basis of the inorganic fine powder is preferably 0.01 to 20% by weight, particularly preferably 0.03 to 5% by weight. The inorganic fine powder treated as above shows positive electrification properties stably.

B. Fine powders of alumina, zinc oxide, magnetite, etc., which are positively electrified in themselves. These fine powders can be preferably used when they have an average particle diameter of about 500 nm or less.

According to this invention, there is provided a nonmagnetic one-component developing method for developing an image by using a developer prepared by attaching fine particles of the additive to be charged reversely to the polarity of the toner to the surface of the toner to be negatively charged, whereby a development operation even for a long period of time is free from occurrence of fusion of the developer onto a developer carrying member and a developer layer thickness control member, and excellent images can be stably produced.

Further, according to this invention, there is provided a developing method which can stably produce excellent images without occurrence of surface scumming and white streaks even when a development operation is carried out for a long period of time.

Examples

This invention will be explained hereinafter by reference to Examples, which, however, shall not limit this invention. In Examples, "part" stands for "part by weight".

Example 1

| | |
|---|---|
| Styrene-acrylate ester copolymer (Pliolite AC, supplied by Goodyear) | 85 parts |
| Low molecular weight polypropylene (Viscol 550P, supplied by Sanyo Kasei Kogyo K.K.) | 2.5 parts |
| Chromium complex salt dye (Bontron S-34, supplied by Orient Chemical Industry) | 2.5 parts |
| Carbon black (#40, supplied by Mitsubishi Chemical Ltd.) | 10 parts |

A mixture of the above components was melted under heat, kneaded, and cooled to room temperature. Then, the kneaded mixture was milled and classified to give toner particles having a particle diameter of 5 to 15 μm and being to be negatively charged. The toner particles showed a charge of −15 μc/g. Further, 0.5 part of a silica fine powder (HVK-2175, supplied by Hoechst) to be positively charged was added to 100 parts of the toner particles, and the resultant mixture was stirred and mixed to attach the silica fine powder to the toner particle surfaces to give a nonmagnetic one-component developer, which showed a charge of −12 μc/g.

The above developer was used to carry out a copying test with a reversal processing method laser printer (LP1060, supplied by Ricoh) having a built-in organic photoconductive drum and a doctor blade formed of a silicone rubber, i.e. a development operation was carried out to give a clear image having no surface scumming. Further, 30,000 copies of an image were produced by a continuous development operation, and the doctor blade as a developer layer thickness control member was observed to show no melted toner. The above thirty thousand copies were also examined to show no difference in image quality and no occurrence of white streaks.

Example 2

| | |
|---|---|
| Styrene-acrylate ester copolymer (Pliolite AC, supplied by Goodyear) | 85 parts |
| Low molecular weight polypropylene (Viscol 550P, supplied by Sanyo Kasei Kogyo K.K.) | 2 parts |
| Chromium complex salt dye | 3 parts |

-continued

| | |
|---|---|
| (Spilon Black TRH, supplied by Hodogaya Chemical Industry Co., Ltd.) | |
| Carbon black (#40, supplied by Mitsubishi Chemical Ltd.) | 10 parts |

A mixture of the above components was treated in the same manner as in Example 1 to give toner particles to be negatively charged. The toner particles showed a charge of −18 μc/g. Further, 0.2 part of a silica fine powder (HVK-2150, supplied by Hoechst) to be positively charged was added to 100 parts of the toner particles, and the resultant mixture was stirred and mixed to attach the silica fine powder to the toner particle surfaces to give a nonmagnetic one-component developer, which showed a charge of −14 μc/g.

A copying test using the above developer was carried out in the same manner as in Example 1 to show similar results to those in Example 1.

Example 3

| | |
|---|---|
| Polystyrene | 85 parts |
| Low molecular weight polypropylene (Viscol 550P, supplied by Sanyo Kasei Kogyo K.K.) | 2 parts |
| Chromium complex salt dye (Bontron, supplied by Orient Chemical Co., Ltd.) | 3 parts |
| Carbon black (#40, supplied by Mitsubishi Chemical Ltd.) | 10 parts |

A mixture of the above components was treated in the same manner as in Example 1 to give toner particles to be negatively charged. The toner particles showed a charge of —17 μc/g. Further, 1.0 part of a silica fine powder (HVK-2115, supplied by Hoechst) to be positively charged was added to 100 parts of the toner particles, and the resultant mixture was stirred and mixed to attach the silica fine powder to the toner particle surfaces to give a nonmagnetic one-component developer, which showed a charge of −12 μc/g.

A copying test using the above developer was carried out in the same manner as in Example 1 to show similar results to those in Example 1.

Comparative Example 1

A toner was prepared by repeating Example 1 except that 0.5 part of a hydrophobic silica to be negatively charged was added as an additive having the same polarity as that of the toner in place of the silica fine powder used in Example 1, and the resultant toner was used to carry out the same copying test as that in Example 1. Initial copies of an image were good. When 1,000 copies of an image were continuously produced, however, a melted toner was found to have adhered to the doctor blade surface, and surface fogging was also observed.

Comparative Example 2

A toner was prepared by repeating Example 1 except that no additive was used, and the resultant toner was used to carry out the same copying test as that in Example 1. Initial copies of an image were good. When 1,000 copies of an image were continuously produced, however, a melted toner was found to have adhered to the doctor blade surface, and surface fogging was also observed.

Table 1 shows densities of image portions (measured with Macbeth RD914), densities of background portions (measured with a color and color difference meter, supplied by Nihon Denshoku Kogyo Co., Ltd.) and states of white streaks with regard to the above Examples and Comparative Examples.

TABLE 1

| | Initial time | | After production of 1,000 copies | | | After production of 30,000 copies | | |
|---|---|---|---|---|---|---|---|---|
| | Density in image portion | Density in background portion | Density in image portion | Density in background portion | White streaks (*) | Density in image portion | Density in background portion | White streaks (*) |
| Ex.1 | 1.49 | 0.21 | 1.47 | 0.11 | O | 1.48 | 0.15 | O |
| Ex.2 | 1.47 | 0.18 | 1.45 | 0.21 | O | 1.49 | 0.31 | O |
| Ex.3 | 1.47 | 0.11 | 1.49 | 0.12 | O | 1.47 | 0.21 | O |
| CEx.1 | 1.47 | 0.19 | 1.49 | 0.81 | X | — | — | — |
| CEx.2 | 1.47 | 0.11 | 1.45 | 1.21 | X | — | — | — |

Ex. = Example, CEx. = Comparative Example
(*): "O" means no appearance of white streaks on an image, and "X" means that a toner was fused and adhered to a developing roll to form streaks, which caused white streaks on an image.

What is claimed is:

1. A contact-type nonmagnetic one-component developing method using a developing apparatus having at least a developer carrying member and a developer layer thickness control member provided so as to be adjacent to, or to be in contact under pressure with, said developer carrying member, which comprises feeding a developer to said developer carrying member, forming a thin layer of the developer on a surface of the developer carrying member with the developer layer thickness control member with negatively charging the developer under friction, bringing the thin layer of the developer into contact with a photoconductive material holding an electrostatic latent image to develop the electrostatic latent image, and transferring the resultant developed image to an image receptor, said developer being a nonmagnetic one-component developer prepared by attaching fine particles of an additive to be positively charged to particles of a toner which is comprised mainly of a binder resin and a colorant and is to be negatively charged, said which developer being designed to be negatively charged under the friction with a hopper, the amount of fine particles of the additive being 0.05 to 3 parts by weight per 100 parts by weight of the toner.

2. A method according to claim 1, wherein the developing apparatus has a developing roll which is formed of an electrically conductive and elastic material or has a surface layer formed of an electrically conductive material.

3. A method according to claim 2, wherein the electrically conductive elastic material is a product produced by dispersing an electrically conductive powder in a rubber-containing material.

4. A method according to claim 1, wherein the developer layer thickness control member is a doctor blade or a roll which rotates reversely to the rotation of the developer carrying member.

5. A method according to claim 1, wherein the photoconductive material holding an electrostatic latent image is a cylindrical photoconductive drum.

6. A method according to claim 1, wherein the toner contains 1 to 10 parts by weight of the colorant per 100 parts by weight of the binder resin.

7. A method according to claim 1, wherein the developer is a product prepared by attaching 0.05 to 3 parts by weight of fine particles of the additive to 100 parts by weight of the particles of the toner.

8. A method according to claim 1, wherein the fine particles of the additive have a positive tribo-electrified value when measured by a blow-off method.

9. A method according to claim 1, wherein the fine particles of the additive are those produced by surface-treatment of an inorganic fine powder with at least one member selected from the group consisting of aminosilane, silicone oil having an amine in the side chain, a silane coupling agent and a titanium coupling agent.

10. A method according to claim 1, wherein the fine particles of the additive are formed of at least one member selected from the group consisting of alumina, zinc oxide and magnetite.

11. A method according to claim 1, wherein the fine particles of the additive have an average particle diameter of 500 nm or less.

* * * * *

UNITED STATES PATENT AND TRADEMARK OFFICE

CERTIFICATE OF CORRECTION

PATENT NO. : 5,534,377

DATED : July 9, 1996

INVENTOR(S) : MASAO TAKANO, RYOZO OKUNO and KIMIHIKO NAKAMURA

It is certified that error appears in the above-indentified patent and that said Letters Patent is hereby corrected as shown below:

Column 9, line 43, after "and" (second occurrence) insert —which—;
line 44, delete "which";
line 45, change "with" to —within—.

Signed and Sealed this

Fourth Day of February, 1997

*Attest:*

*Attesting Officer*

BRUCE LEHMAN

*Commissioner of Patents and Trademarks*